United States Patent [19]

Beck et al.

[11] 4,048,047

[45] Sept. 13, 1977

[54] ELECTROCHEMICAL CELL WITH BIPOLAR ELECTRODES

[75] Inventors: Fritz Beck, Ludwigshafen-Oggersheim; Diethard Francke, Ludwigshafen; Heinz Nohe, Meckenheim; Heinz Hannebaum, Ludwigshafen-Oppau; Manfred Stroezel, Ilvesheim, all of Germany

[73] Assignee: BASF Aktiengesellschaft, Ludwigshafen, Germany

[21] Appl. No.: 648,917

[22] Filed: Jan. 14, 1976

[30] Foreign Application Priority Data

Jan. 21, 1975 Germany ..... 2502167

[51] Int. Cl.[2] ..... C25B 1/26; C25B 9/00

[52] U.S. Cl. ..... 204/270; 204/269; 204/275; 204/278

[58] Field of Search ..... 204/270, 268, 269, 59 R, 204/275, 278

[56] References Cited

U.S. PATENT DOCUMENTS

| | | | |
|---|---|---|---|
| 913,827 | 3/1909 | Korten | 204/149 |
| 3,787,299 | 1/1974 | Beck et al. | 204/59 R |
| 3,900,377 | 8/1975 | Enns et al. | 204/149 |

*Primary Examiner*—Arthur C. Prescott
*Attorney, Agent, or Firm*—Keil, Thompson & Shurtleff

[57] ABSTRACT

An electrochemical cell with a nonpartitioned electrolyte chamber and plane electrodes, which form a stack, the chamber filled by the electrolyte forming narrow gaps between the electrodes, and the electrode stack being assembled on a fixed baseplate so that its axis is essentially vertical.

2 Claims, 4 Drawing Figures

ELECTROCHEMICAL CELL WITH BIPOLAR ELECTRODES

Figure 1:
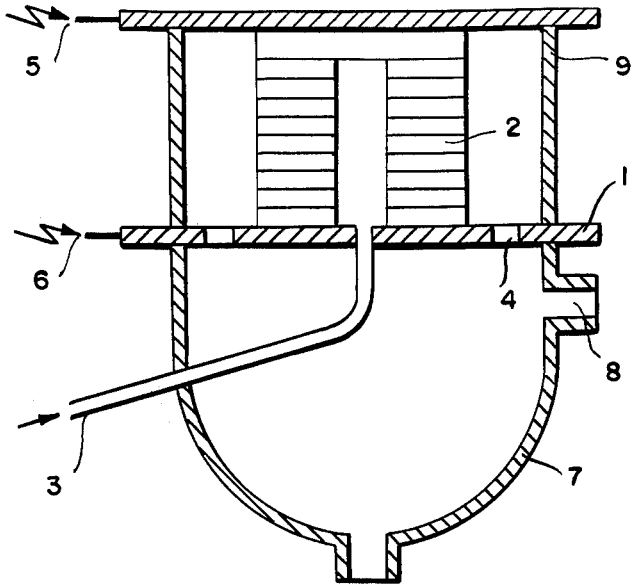

The present invention relates to an electrochemical cell for producing chemical reactions with the aid of direct current.

From a technological point of view, an electrochemical cell should permit the particular electrochemical process to be carried out with minimum expenditure of electrical energy and maximum spacetime yield. From a constructional point of view, the cell should conform to certain economic and practical requirements, such as inexpensive materials for the housing and electrodes, uncomplicated components and rapid assembly and dismantling.

Circuits are classified as monopolar or bipolar depending on the mode of action of the individual electrodes. In trough cells the electrodes, which stand, or are suspended, vertically, are in most cases monopolar. However, the cost of the housing or troughs is considerable. In frame-and-plate cells, the electrodes may be monopolar or bipolar. The separation of the electrode chambers presents no difficulty. A disadvantage of this arrangement is the need to use a plurality of gaskets.

This advantage is avoided almost entirely in the plate stack cell. In a particularly simple embodiment, the cell consists of a stack of circular electrode plates, wired bipolar in series, the plates each having a central hole and being arranged closely spaced. The electrolyte preferably flows radially outward. The spacers used are radial strips of insulating material. If the strips are sufficiently thin (from 0.05 to 2.0 mm), a capillary gap cell results. Details of the construction of such a cell have been disclosed in the context of the electrosynthesis of adipodinitrile in U.S. Pat. No. 3,616,320 (cf. also J. Appl. Electrochem. 2, (1972), 59) and in the context of the electrosynthesis of dimethyl sebacate in U.S. Pat. No. 3,787,299 (cf. also Electrochim. Acta 18 (1973), 359). It should be mentioned that in this capillary gap cell the individual electrodes are conjointly accommodated in a non-partitioned electrolyte chamber; the stray currents which occur are generally slight, because of the geometry of the stack, and are tolerated because of the simple construction achieved. For other details, references may be made to the above descriptions.

Hitherto, the electrodes of the plate stack cell have been arranged horizontally and fixed, as a stack, to the cover of the cell. The electrolyte feed, and the electrical supply to the stack, are brought in exclusively from the top, through a cell head of appropriate design.

This arrangement has disadvantages. For example, it is hardly possible to extend the cell by enlarging the plates and/or increasing their number, e.g. when transferring from an experimental scale to production scale, since as a rule, e.g., the load on the cell cover is excessive. Furthermore, whenever the plate stack is assembled or dismantled, the feed line to the interior of the stack must be assembled or dismantled. Furthermore, the electrode spacings can change appreciably as a result of heat exposure of the electrodes or due to the swelling action of systems containing solvents.

We have found that these disadvantages are avoided by the electrochemical cell according to the invention (cf. FIGS. 1 and 2), in which the bipolar electrodes are again arranged closely spaced and are conjointly accommodated in a non-partitioned electrolyte chamber. The essential features of the cell of the invention include a baseplate 1, a plate stack 2 having a central hole, the stack being built up on the baseplate and extending upward, means of feeding liquid 3 into the central hole, and means of introducing electric current 5 and 6.

Accordingly, the invention relates to an improved electrochemical cell, wherein plane electrodes of circular shape are located in a conjoint electrolyte chamber and are spaced from 0.05 to 2 mm apart (the spacing being fixed by radial insulating strips), sets of several electrodes being so arranged, in the form of a stack, that with the exception of the outermost electrodes each electrode acts both as an anode and as a cathode, and the entire stack being accommodated in a closed reaction vessel and being provided with means whereby electrolyte liquid can be fed into the center of the stack, the improvement being that the electrode stack is built up on a central baseplate which serves as a carrier, contains means of feeding-in the electrolyte liquid and is in electrically conductive connection with the plate stack whilst being electrically insulated from the reaction vessel.

Figure 2:
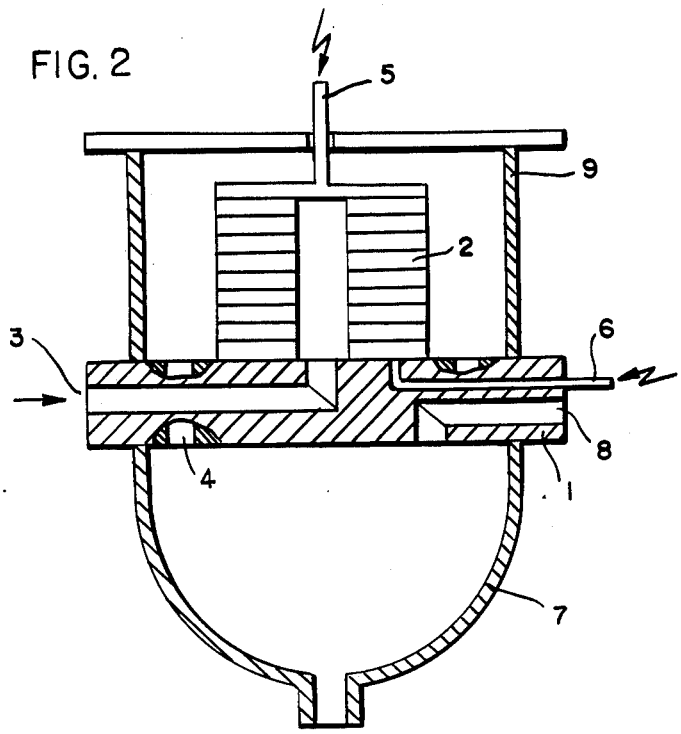

The liquid feed may comprise a separate pipeline, as shown in FIG. 1, or may be integral with the baseplate (FIG. 2). Since the baseplate is, advantageously, the fixed part of the equipment whilst the remaining parts are detachable, the latter form of feed is to be preferred.

The outgoing liquid in general passes through holes 4 in the baseplate into a collecting vessel 7 located below the said plate but sealed onto it, from which collecting vessel it passes, through an appropriate outlet 8 to a further treatment stage, or is partially recycled into the cell (through a heat exchanger).

In addition, the equipment usually has a covering hood 9 to avoid losses of gaseous reactants or reaction products or, if desired, to permit operating under superatmospheric pressure.

The current can be supplied directly through the covering hood and the baseplate (FIG. 1) or through appropriately constructed end plates of the electrode stack (FIG. 2).

Figure 3:
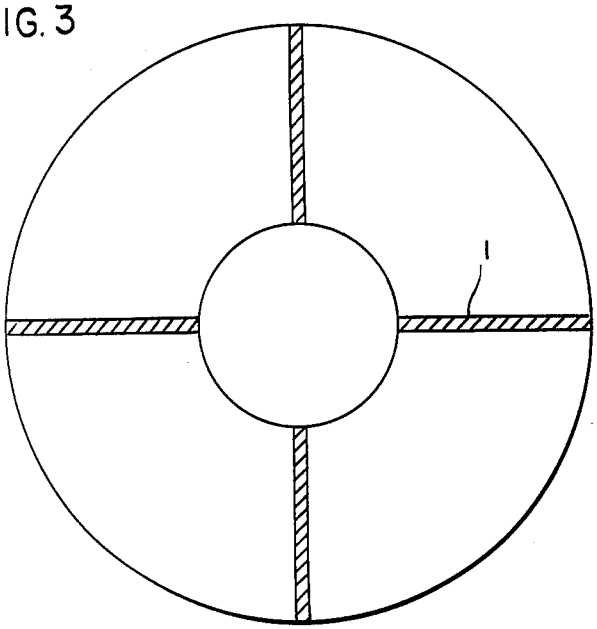
Figure 4:
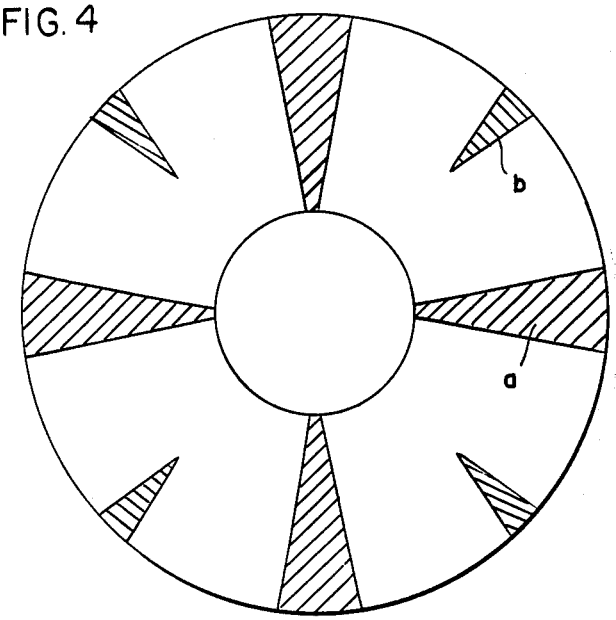

The plate stack is preferably of rotationally symmetrical construction and thus consists of individual essentially circular plates with a central inner hole. The liquid flows outward through the plate stack; to this extent, there is no difference from the prior art. To avoid large changes in flow rate and hence greatly differing extents of chemical reaction in the electrode gap, the ratio of the central hole to the outer diameter should not be too small. A ratio of about 1:3 has proved particularly favorable. The spacing of the electrodes is fixed in the conventional manner, as shown in FIG. 3, by means of radial strips of insulating non-swelling material, e.g. of polypropylene or polyethylene glycol terephthalate, which must be of the desired thickness. The spacers can also be wedge-shaped, as shown in FIG. 4, the wedges tapering inward and extending either as far as the inner hole *a* or as far as an end point within the electrode gap *b*. In this way, a more even flow through the equipment is achieveable. The flow within the electrode plate stack can also be made more even, e.g. by a coaxially located displacement member in the form of a suspended truncated cone.

The spacing of the bipolar electrode plates can vary within wide limits, but should be from 0.05 to 2 mm. This is because for many electrochemical reactions it is desirable to select a very small spacing so as to keep down the cell voltage and hence the power consumption and to achieve a high space-time yield, and a low volume flow rate of the circulating electrolyte at a given flow rate.

The plates themselves can be circular or be of approximately circular geometrical shape. A circular shape permits industrial manufacture of plates of high planarity without great expense and makes it possible to set the electrode spacing to less than 1 mm.

With this cell construction, the liquid which externally surrounds the plate stack in operation is an electrical shunt, as already indicated, but this is unimportant if the plate thickness is large compared to the thickness of the capillary gap and can be made less important still if the electrode plates are each surrounded by tightly fitting rings of insulating material. The arrangement according to the invention offers an additional advantage in this connection, in that the liquid issuing from the stack only forms a thin film which runs down the outside of the stack. Whether this advantage can be utilized depends, of course, on the conductivity of the liquid; if it is low, the loss current observed is generally lower than if the conductivity is high.

In some cases, e.g. in the electrolysis of solutions containing hydrogen halides, the medium which is to undergo reaction can attack metals present inside the cell. This applies, e.g., to the contact plates, the metallic baseplate and the pipelines. Even very slight attack on the metals causes problems if a cathodic reduction on lead cathodes or graphite cathodes — e.g. the reduction of acetone to pinacol — is being carried out, since the process fails if the cathodes are poisoned by traces of iron or copper. In such cases it is necessary to protect all metallic parts of the cell, except for the electrodes, against direct exposure to the medium. In that eventuality, the load-bearing parts of the baseplate shown in FIG. 2 are made of a plastic, e.g. polypropylene. The contact plate is set into this baseplate and sealed from the exterior, e.g. by means of 0-rings. The current lead 6 enters through a liquid-tight passage in the baseplate. The upper contact plate can be surrounded by plastic in the same way.

Assembly and dismantling of the plate stack is facilitated if, with the cell housing removed, the stack is assembled directly on the baseplate. The plate stack can be inserted into the cell, and removed therefrom, as a single unit, from above.

The material used for the electrode plates of the cell depends on the nature of the electrode process to be carried out. It is advantageous to use composite electrodes. These are produced by applying the intended electrode layer to a plate of graphite, titanium, aluminum or stainless steel, by electro-deposition, by gluing of a thin foil using a conductive metallic adhesive, or by (electroless) plating.

Examples of electrode layers are anodic layers of platinum, activated titanium or tantalum, lead dioxide, magnetite or manganese dioxide; and cathodic layers of lead, lead amalgam, cadmium, nickel and stainless steel.

In a particularly simple construction, the plates consist of graphite or graphite-filled plastic, and accordingly both the cathode and the anode consist of graphite.

The cell may be used for batchwise or continuous operation. In continuous operation, it is possible to pass the electrolyte through several cells, i.e. to form a cascade of the cells, or to arrange the cells in a mixing circuit, to which fresh electrolyte is fed continuously and from which reacted electrolyte is taken off continuously.

A construction which has successfully been tested in practice is the following (FIG. 2): the baseplate 1 consists of polypropylene and contains the electrolyte feed 3. A steel current lead 6 is set into the baseplate.

The plate stack 2 is composed of 11 discs of synthetic graphite of external diameter 200 mm. The diameter of the inner hole is 65 mm. The thickness of the bipolar plates is 15 mm. The spacing of the plates is determined by four radial strips of 0.5 mm thick polypropylene, which have a wedge-shaped inward taper. The number of electrode pairs or electrode chambers is thus 10. Taking into account the zones masked by the spacers, the total anode surface and total cathode surface are each 26 $dm^2$.

The end plates, which are 30 mm thick, are each connected up via a screwed-on stainless steel plate which is hermetically sealed from the electrolyte by means of 0-rings made of Viton A®. The plate stack is held together by three bolts set at intervals of 120°, at the periphery. The cell is mounted in a cylindrical housing 9 of glass which forms part of a liquid circulation system. This system further comprises a gas separator 7 below the cell, a centrifugal pump and a heat exchanger.

To demonstrate the mode of action of the cell, the electrochemical oxidation of propylene to propylene oxide in dilute NaBr solution (bromohydrin process) is carried out.

At the beginning of the experiment, the cell is charged with 45 kg of a 2 percent strength sodium bromide solution. The solution is circulated at a flow rate of 2.6 $m^3$/hr (corresponding to a mean (linear) speed of 35 cm/sec in the electrode gap). On the input side of the cell is a gassing valve through which propylene is very finely dispersed in the electrolyte at a volume rate of 120 liters (S.T.P.) per hour, corresponding to a calculated 10 percent excess over the stoichiometric amount for the amount of current used. The unreacted propylene, together with the hydrogen from the electrolyte, leaves the cell and passes through a cooler (25° C) and subsequently through a cold trap (−20° C).

After switching on a current of 26 A, corresponding to a current density of 10 A/$cm^2$, the overall potential assumes a value of 31.0 volt. The temperature in the electrolyte is kept at 45° C by cooling with river water. The pH is kept at 9.0 by metering half-concentrated hydrobromic acid through a pneumatically controlled valve. After one hour, the propylene concentration in the electrolyte, determined by gas chromatography (against n-butanol as the internal standard) is 0.45%; after 2 hours it is 0.82%, and after 3 hours, 1.20%. The mean current efficiency for propylene oxide during this initial period is thus 58%. The dibromopropane formed as a by-product initially dissolves in the electrolyte. When its solubility has been exceeded, it appears as an oil phase which is retained in a separator in the electrolyte circulation. After 3 hours, the amount of dibromopropane present (0.1%) corresponds to a mean current efficiency of 1.5%. The consumption of HBr required to keep the pH constant is 0.7 mmole/A.hr. At the end of the initial period of three hours, 2 percent strength NaBr solution is fed to the reactor at a rate of 9 l/hr and (reaction) solution containing propylene oxide is taken off at the same rate, and worked up. During this period of continuous operation the current efficiency for propylene oxide was 42%.

EXAMPLE

An electrochemical cell for the electro-synthetis of di-2-ethylhexyl sebacate from mono-2-ethylhexyl adipate is constructed in accordance with the principle illustrated in FIG. 1, as follows:

The baseplate 1 consists of 10 mm thick stainless steel, material No. 1 45 71, and comprises the electrolyte feed 3 and a cable connection 6 for the current supply. The plate stack 2 is composed of 11 round plates of synthetic graphite, coated with a 50 $\mu$ thick platinum foil. The outer diameter of the plate is 130 mm and the diameter of the inner hole is 20 mm. The thickness of the end plate, which does not have a central hole, is 30 mm, whilst the bipolar plates are 15 mm thick. The spacing between the electrodes is fixed by four radial polypropylene strips, 0.5 mm thick and 3 mm wide.

There are 10 pairs of electrodes, which each have an active electrode surface area of 1.25 $dm^2$ and accordingly, together, an area of 12.5 $dm^2$. The end plate is connected up through a screwed-on stainless steel plate, material No. 1 4571, resting on the end electrode. The plate stack is contained in a cylindrical vessel of heavy duty glass. The baseplate and the end plate are held together by three bolts set at intervals of 120°, at the periphery. This glass vessel forms part of a liquid circulation system which further comprises a gas separator directly below the cell, a centrifugal pump and a heat exchanger. The electrolyte is circulated by means of a metering pump upstream from the cell, and leaves the cell through an overflow at the gas separator. The gases formed are discharged through a heat exchanger.

At the beginning of the experiment, the cell is charged with 6,220 g of electrolyte, consisting of 2,458 g of mono-2-ethylhexyl adipate, 3,686 g of methanol and 76 g of 50 percent strength sodium hydroxide solution. The electrolyte is circulated at a rate of 7.35 $m^3$/hr, and issues at the electrode gap at a (linear) speed of 1 m/sec.

After switching on a current of 25 A, corresponding to a current density of 20 A/$dm^2$, the overall potential assumes a value of 110 V. The temperature is kept at 50° C. The current is interrupted periodically for 15 seconds every 20 minutes.

After a start-up time of 1 hour, 1,769 g of mono-2-ethylhexyl adipate have been consumed and at the same time the acid number drops from 77.2 to 15.5. This acid number is maintained by continuously metering-in 6,220 g of electrolyte per hour.

5,864 g of electrolyte per hour leave the circulation system through the overflow. 302 g of $CO_2$, 7 g of $H_2$ and 47 g of methanol per hour leave the cell through the gas cooler.

3,639 g of methanol and 38 g of water are removed from the electrolyte in a thin film evaporator. The residue obtained consists of 1,824 g of crude diisooctyl sebacate. The crude ester is stirred with 110 g of 5 percent strength NaOH and the aqueous phase is separated off. The organic phase is washed neutral with three times 1,800 ml of water and is then flushed for 2 hours with saturated steam. This removes the volatile by-products. 1,168 g of di-2-ethylhexyl sebacate, which according to analysis by gas chromatography is 99.5 percent pure, are obtained.

The salt solution which has been separated off, and the wash water, are acidified to pH 2 with sulfuric acid. The mono-2-ethylhexyl adipate which is separated off is washed free from sulfuric acid with water and can be recycled.

The current efficiency is 58.8%.

The material conversion is 80.0%.

We claim:

1. In an electrochemical cell, wherein plane electrodes of circular shape are located in a conjoint electrolyte chamber and are spaced from 0.05 to 2 mm apart, the spacing being fixed by radial insulating strips, sets of several electrodes being so arranged, in the form of a stack, that with the exception of the outermost electrodes each electrode acts both as an anode and as a cathode, and the entire stack being accommodated in a closed reaction vessel and being provided with means whereby electrolyte liquid can be fed into the center of the stack, the improvement that the electrode stack is built up on a central baseplate which serves as a carrier, contains means of feeding-in the electrolyte liquid and is in electrically conductive connection with the plate stack whilst being electrically insulated from the reaction vessel.

2. A cell as claimed in claim 1, wherein the outermost electrodes of the stack can be brought into electrically conductive connection with a source of direct current and are provided with means for producing this connection.

* * * * *